United States Patent [19]

Bennett et al.

[11] 4,317,336

[45] Mar. 2, 1982

[54] ELECTRON DISCHARGE TUBE COOLING SYSTEM

[75] Inventors: Arthur J. Bennett; Peter R. T. Roberts, both of Cambridge, England

[73] Assignee: Pye (Electronic Products) Ltd., Cambridge, England

[21] Appl. No.: 161,086

[22] Filed: Jun. 19, 1980

[30] Foreign Application Priority Data

Jul. 27, 1979 [GB] United Kingdom ..... 26212/79

[51] Int. Cl.[3] ..... F25B 19/00

[52] U.S. Cl. ..... 62/514 R; 62/54; 62/118; 62/119; 165/104.27

[58] Field of Search ..... 62/118, 119, 514 R, 62/54; 165/105

[56] References Cited

U.S. PATENT DOCUMENTS 1,887,687 11/1932 Killeffer ..... 62/119
3,561,229 2/1971 Levin ..... 62/119
3,848,424 11/1974 Rhea ..... 62/119

*Primary Examiner*—Ronald C. Capossela
*Attorney, Agent, or Firm*—Robert J. Kraus

[57] ABSTRACT

An electron discharge tube evaporation cooling system in which part of a tube to be cooled is immersed in coolant in a boiler (15), the cooling system further comprising a condenser (18) for vapor generated in the boiler (15), and a coolant reservoir (11). The flow of vapor from the boiler (15) to the condenser (18) experiences resistance in the interconnecting pipe (17), producing in the boiler (15) a back pressure dependent on the dimensions of the pipe (17). In order that a desired level (40) of coolant in the boiler (15) can be obtained for a range of back pressures, the coolant is supplied to the boiler via an overflow system (16) having an adjustable overflow level. The overflow system (16) comprises a chamber (31) open to atmosphere at the top (34) and having at the bottom (33) an opening (36) through which an overflow tube (35) passes. The opening (36) is provided with a liquid-tight gland (37) comprising a compressible ring (42) and a pressure member (43) adjustable to allow the tube (35) to be slid through or to lock it in position.

3 Claims, 3 Drawing Figures

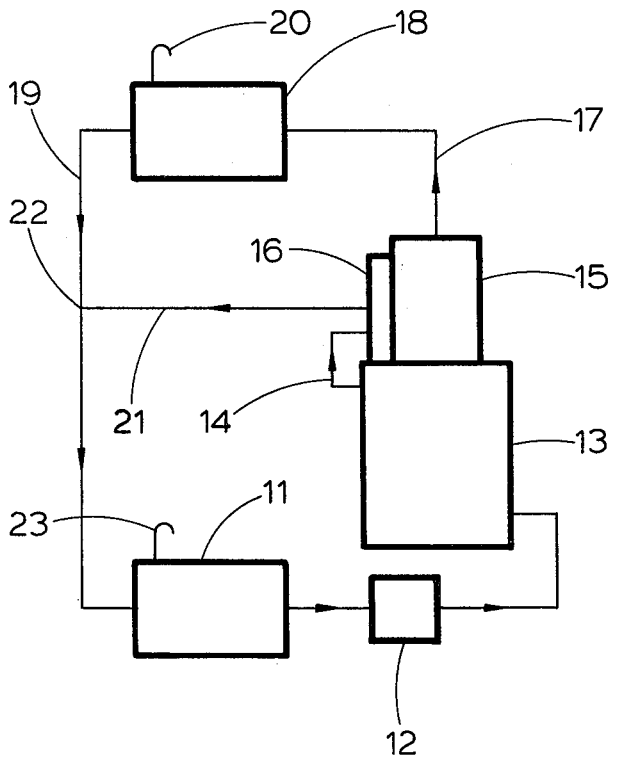
Fig. 1
Fig. 3
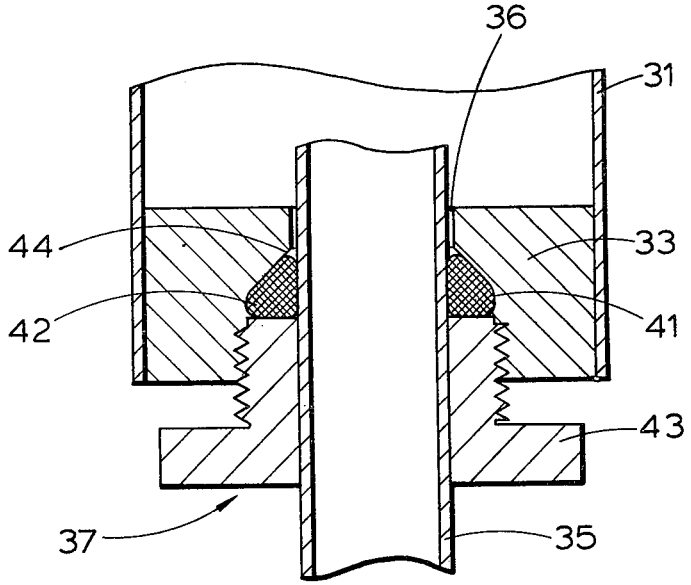

ELECTRON DISCHARGE TUBE COOLING SYSTEM

BACKGROUND OF THE INVENTION

This invention relates to electron discharge tube cooling systems, and more specifically to liquid evaporation cooling systems for klystrons and other high-power electron discharge tubes.

In such tubes, a major proportion of the heat to be removed by the cooling system may be generated in one specific part of the tube, for example in the collector of a high-power klystron.

A liquid cooling system for such tubes is described in United Kingdom Patent Specification No. 1,114,513. In this system, a part of a tube to be cooled is immersed in coolant in a boiler. The coolant is supplied to the boiler by pump means for a coolant reservoir via an inlet pipe at a low level therein. The coolant is also supplied to an overflow system which is external to the boiler and has an overflow level at the level desired to be maintained in the boiler, coolant overflowing in the overflow system being returned to the reservoir. Vapourised coolant from the boiler is condensed by a condenser and the condensate is returned to the coolant reservoir. An additional cooling chamber, adapted to cool a separate part of the electron discharge tube, such as the drift tube assembly of a klystron, may be connected in series with the coolant flow to the boiler and overflow system.

In arrangements of the type described in U.K. Specification No. 1,114,513, the overflow system is subject to atmospheric pressure. If the pressure in the boiler exceeds atmospheric pressure, the excess pressure will depress the level of the coolant in the boiler below the desired level.

Although the condenser for the vapour generated in the boiler may itself be vented to atmosphere, the boiler will still be subject to a back pressure caused by the resistance which the flow of vapour experiences in the interconnected pipework from the boiler to the condenser. It is therefore necessary to arrange the interconnecting pipework so that the back pressure does not depress the coolant in the boiler below a safe level. The tube manufacturer may specify a maximum value, typically $2.5\times10^2$Pa (2.5 cm water gauge), for the back pressure in order to ensure safe operation of the tube in a cooling system of the type hereinbefore described.

In many applications the requirement that the back pressure shall not exceed a low value such as $2.5\times10^2$Pa is difficult to obtain and requires expensive measures. In the case of a kylstron rated t 45 kW output power such as may be employed in an output stage of a television transmitter, it is focused necessary to use pipes of 4 inch (10 cm) internal diameter between the boiler and the condenser even when the latter can be located close to the former. In many instances, considerations of available space make it necessary to position the condenser at some distance from the boiler. In such instances, pipes of 6 inch or 8 inch (15 cm or 20 cm) internal diameter may be necessary to avoid excessive back pressure. Moreover, to avoid contamination of the coolant, which typically comprises deionised water, the pipes must be fabricated from materials such as high-purity copper or suitable grades of stainless steel. Such pipework is difficult to fabricate and to install, and is extremely costly. Substantial savings in pipework costs would be possible if the desired coolant level in the boiler could be obtained for a range of back pressures.

SUMMARY OF THE INVENTION

It is an object of the present invention to provide a cooling system for an electron discharge tube wherein a desired level of coolant in the boiler may be attained for a range of values of the back pressure.

For that purpose, an evaporation cooling system for an electron discharge tube of the type in which part of the tube to be cooled is immersed in coolant in a boiler, which system comprises means for condensing coolant vapour generated in the boiler, means for returning the condensate to a reservoir and means including an overflow system, for supplying coolant from the reservoir to an inlet of the boiler, wherein the level of the coolant in the boiler is determined by an overflow system and the pressure of the coolant vapour in the boiler, surplus coolant from the overflow system being returned to the reservoir, is characterised according to the invention in that the overflow level in the overflow system is adjustable. In this manner, a desired level of coolant in the boiler can be obtained for a range of back pressures, thereby enabling the use in each case of relatively small diameter and hence less expensive pipework for the connection of the boiler to the condenser.

BRIEF DESCRIPTION OF THE DRAWING

In order that the invention and the manner in which it is to be performed may more readily be understood, an embodiment thereof will be described, by way of example, with reference to the attached diagrammatic drawing, in which:

FIG. 1 represents schematically a cooling system embodying the invention;

FIG. 3 is a cross-section, to an enlarged scale, of a detail of the overflow system of FIG. 2.

DESCRIPTION OF THE PREFERRED EMBODIMENT

Figure 2:
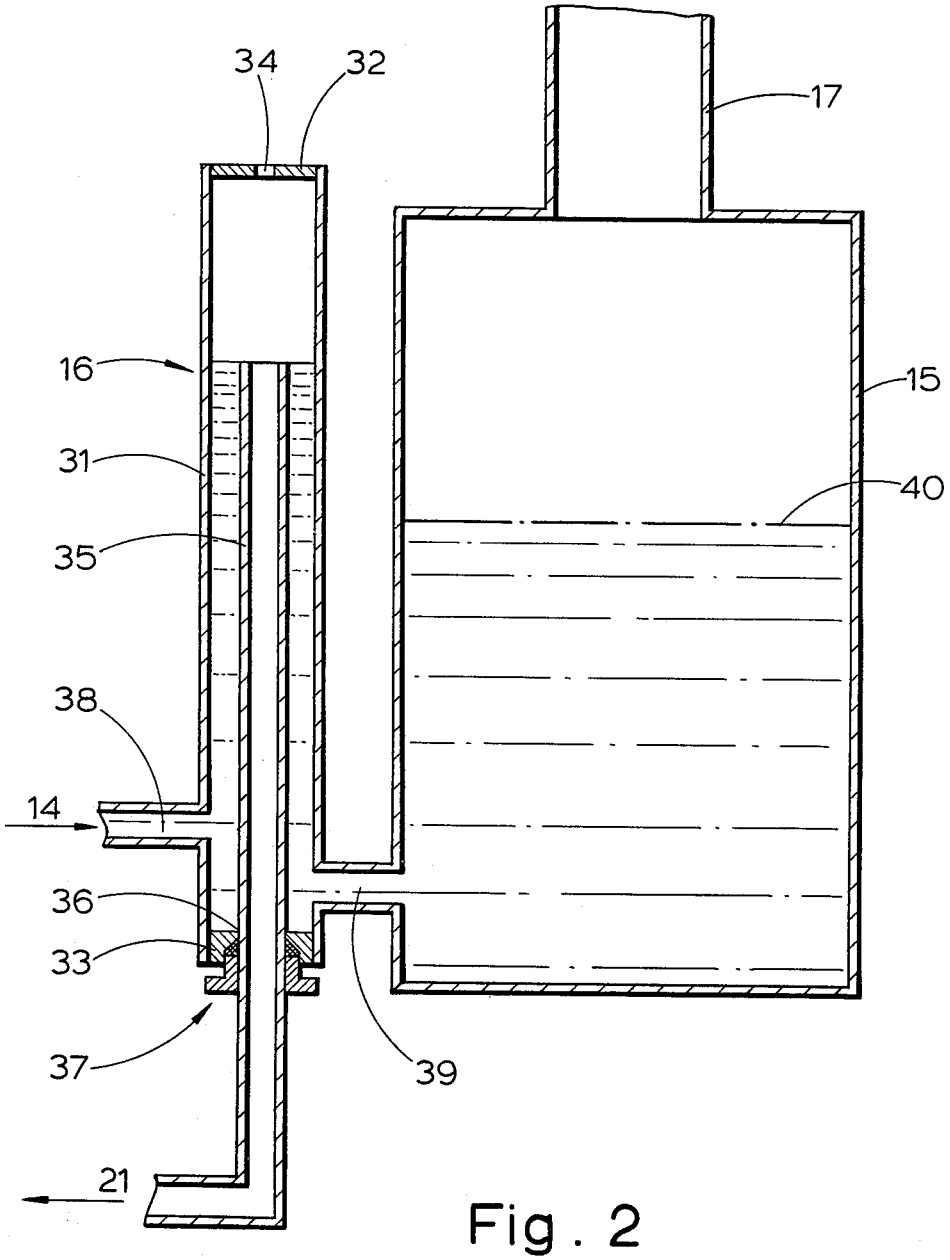
FIG. 2 is a schematic cross-section of a boiler and an overflow system for use in the system of FIG. 1.

Referring to FIG. 1 (in which pipes are diagrammatically represented by single lines), cooling water from a reservoir 11 is supplied by a pump 12 to a cooling jacket 13 for a klystron body (the klystron not being shown in FIG. 1). The cooling water levels the jacket 13 by a pipe 14 and enters a boiler 15, in which the klystron collector is situated, via an overflow system 16 to be described hereinafter with reference to FIG. 2. Steam generated in the boiler 15 is led by a pipe 17 to a condenser 18, and condensate is returned to the reservoir 11 by a pipe 19. The condenser 18 is vented to atmosphere at 20. Surplus water from the overflow system 16 is returned to the reservoir 11 via a pipe 21 which is joined to the pipe 19 at 22. The reservoir 11 is vented to atmosphere as shown schematically at 23.

Turning now to FIG. 2, the overflow system 16 comprises a chamber 31 in the form of a vertical tubular body closed at top and bottom by members 32 and 33. A first opening 34 provided in the top member 32 connects the interior of the chamber 31 to atmosphere.

A tube 35 coaxial with the chamber 31 passes through a second pening 36 in the bottom member 33 and is slidable therein. A gland arrangement 37, shown in greater detail in FIG. 3 and described below, provides a seal between the tube 35 and the member 33. The lower end of the tube 35 is connected to the pipe 21 (FIG. 1)

which is flexible to permit of vertical movement of the tube 35.

An inlet 38 near the bottom of the chamber 31 is connected to the pipe 14 (FIG. 1). Coolant enters the chamber 31 through the inlet 38 and some of this coolant is supplied to the boiler 15 through a pipe 39 connecting the chamber 31 to the boiler at a low level. Surplus coolant entering the chamber 31 overflows into the tube 35 whence it is returned to the reservoir 11. Thus the height of the top of the tube 35 determines the pressure at which coolant enters the boiler through the tube 39. Coolant rises in the boiler 15 to a level lower than the level of the top of the tube 35. This difference in levels depends on the back pressure generated in the pipe 17. In this embodiment, the back pressure equals the vapour of coolant in the boiler minus atmospheric pressure. The level of the top of the tube 35 may be adjusted by sliding the tube in the gland 37. Thus the level of coolant in the boiler 15 can be brought to the desired level, as indicated by the broken line 40.

Turning to FIG. 3, the gland arrangement 37 comprises a bore 41 provided in the end member 33. A flexible packing ring 42 surrounds the tube 35 and is compressed by a gland nut 43 against a sloping face 44 of the bore 41 and against the wall of the tube 35.

The gland nut 43 may be tightened sufficiently to provide a seal for the coolant while permitting sliding movement of the tube 35. When the desired level of coolant in the boiler has been obtained by slidably adjusting the tube 35, the gland nut 43 may be further tightened to lock the tube 35 in position.

We claim:

1. An electron discharge tube cooling system of the type in which part of the tube to be cooled is immersed in a coolant contained in a boiler, said system comprising:

a. a reservoir for the coolant;

b. means for supplying coolant from the reservoir to a submerged inlet for the boiler;

c. a condenser, connected to the boiler, for condensing coolant vapor generated in the boiler;

d. means for returning the condensate produced by the condenser to the reservoir;

wherein said means for supplying coolant to the boiler includes an overflow system for adjustably determining the level of the coolant in the boiler, said overflow system comprising:

e. an inlet connected to the reservoir for receiving coolant therefrom;

f. an outlet connected to the boiler inlet for supplying coolant thereto;

g. means for adjustably establishing a coolant overflow level in the overflow system;

h. means for returning surplus coolant from the overflow system to the reservoir;

said coolant overflow level determining the pressure at which coolant enters the boiler inlet, which in turn determines the coolant level in the boiler for a predetermined vapor pressure in the boiler.

2. An electron discharge tube cooling system as in claim 1 wherein said means for adjustably establishing the coolant overflow level comprises:

a. a chamber, vented to atmospheric pressure, for containing the coolant in the overflow system; and b. a vertically-adjustable tube positioned in the chamber, said tube having an open upper end for receiving surplus coolant, and having the other end connected to said means for returning surplus coolant from the overflow system to the reservoir, said tube being adjusted to establish said coolant overflow level.

3. An electron discharge tube cooling system as in claim 2 wherein said tube passes through an opening in the chamber which permits vertical sliding movement of the tube and where leakage of coolant from the chamber is prevented by gland means comprising compressable sealing means and an adjustable pressure member, whereby the pressure applied to the sealing means can be selectively adjusted to permit said sliding movement or to lock the tube in position.

* * * * *